US007311213B2

(12) United States Patent
Mizuta et al.

(10) Patent No.: US 7,311,213 B2
(45) Date of Patent: Dec. 25, 2007

(54) CRANE

(75) Inventors: Tokihiko Mizuta, Akashi (JP); Osamu Toudou, Akashi (JP)

(73) Assignee: Kobelco Cranes Co., Ltd., Tokyo (JP)

( * ) Notice: Subject to any disclaimer, the term of this patent is extended or adjusted under 35 U.S.C. 154(b) by 268 days.

(21) Appl. No.: 10/961,076

(22) Filed: Oct. 12, 2004

(65) Prior Publication Data

US 2005/0098522 A1 May 12, 2005

(30) Foreign Application Priority Data

Oct. 17, 2003 (JP) ..... 2003-357640

(51) Int. Cl.
*B65C 23/82* (2006.01)

(52) U.S. Cl. ..... 212/298; 212/299; 212/239; 212/262

(58) Field of Classification Search ..... 212/298, 212/239, 240, 262, 299
See application file for complete search history.

(56) References Cited

U.S. PATENT DOCUMENTS

D134,464 S * 12/1942 Zeilman ..... D34/34
2,383,172 A * 8/1945 Wagner et al. ..... 212/300
2,572,029 A 10/1951 Huston
6,536,615 B2 3/2003 Nishikino et al.
6,702,131 B2 3/2004 Hanamoto

FOREIGN PATENT DOCUMENTS

DE 43 27 991 A1 * 2/1995
JP 2000-143160 A * 5/2000
JP 2002-46983 A * 2/2002

* cited by examiner

*Primary Examiner*—Thomas J. Brahan
(74) *Attorney, Agent, or Firm*—Oblon, Spivak, McClelland, Maier & Neustadt, P.C.

(57) ABSTRACT

A crane including a cabin provided on the left or right side, a boom raised and lowered around a pair of boom feet provided on the left and right sides of the base of the boom, and a gantry provided behind the boom. The boom foot on the side of the cabin is located in a position determined by the width of the crane and the width of the cabin. The center line of the boom is located on the opposite side of the center line of the gantry from the cabin so that the distance between the boom foot on the opposite side from the cabin and the center line of the gantry is greater than the distance between the boom foot on the side of the cabin and the center line of the gantry.

3 Claims, 3 Drawing Sheets

CRANE

BACKGROUND OF THE INVENTION

1. Field of the Invention

The present invention relates to a lattice boom type crane.

2. Description of the Related Art

On the left and right sides of an upper rotating body of a crawler crane, various types of equipment are provided. Since the space (width) occupied by the equipment is predetermined, the remaining space (width) is used for disposing a gantry. The distance from the right end of the upper rotating body to the center line A of the gantry is obtained from e1+d, wherein e1 is the width occupied by the equipment on the right side (e2 is the width occupied by the equipment on the left side), and d is half of the remainder.

Since the center line B of the boom corresponds with the center line A of the gantry, the determination of the width g of the cabin automatically determines the distance f1 between the boom feet to be (e1+d−g)×2.

Therefore, the distance f1 between the boom feet is restricted, so the load supporting ability of the boom cannot be improved and the weight of the boom cannot be reduced.

SUMMARY OF THE INVENTION

It is an object of the present invention to provide a crane in which the distance between boom feet is increased to improve the load supporting ability of a boom, and consequently the weight of the boom can be reduced.

The crane according to the present invention has the following basic structure.

That is to say, the crane according to the present invention has a lower traveling body; and an upper rotating body mounted on the lower traveling body, the upper rotating body having a rotating frame. In addition, the crane has a cabin provided on the left or right side of the rotating frame; a boom supported in the front part of the rotating frame; a gantry provided behind the boom; and a plurality of spreaders disposed between the gantry and the boom, each of the spreaders having a sheave; and a winch for driving a rope extended between or among the sheaves. The boom is raised and lowered around a pair of boom feet provided on the left and right sides of the base of the boom. The boom foot on the side of the cabin is located in a position determined by the width of the crane and the width of the cabin. The center line of the boom is located on the opposite side of the center line of the gantry from the cabin so that the distance between the boom foot on the opposite side from the cabin and the center line of the gantry is greater than the distance between the boom foot on the side of the cabin and the center line of the gantry.

Since the center line of the boom is located on the opposite side of the center line of the gantry from the cabin, the distance between the boom feet can be increased. Therefore, the load supporting ability of the boom can be improved. Consequently, the weight of the boom can be reduced. Alternatively, the length of the boom can be increased.

DESCRIPTION OF THE PREFERRED EMBODIMENTS

The embodiments of the present invention will now be described with reference to the drawings.

First, the overall structure of a crawler crane will be described with reference to FIGS. 1 and 4. The crawler crane is a typical example of a lattice boom type crane to which the present invention is applied.

Figure 4:
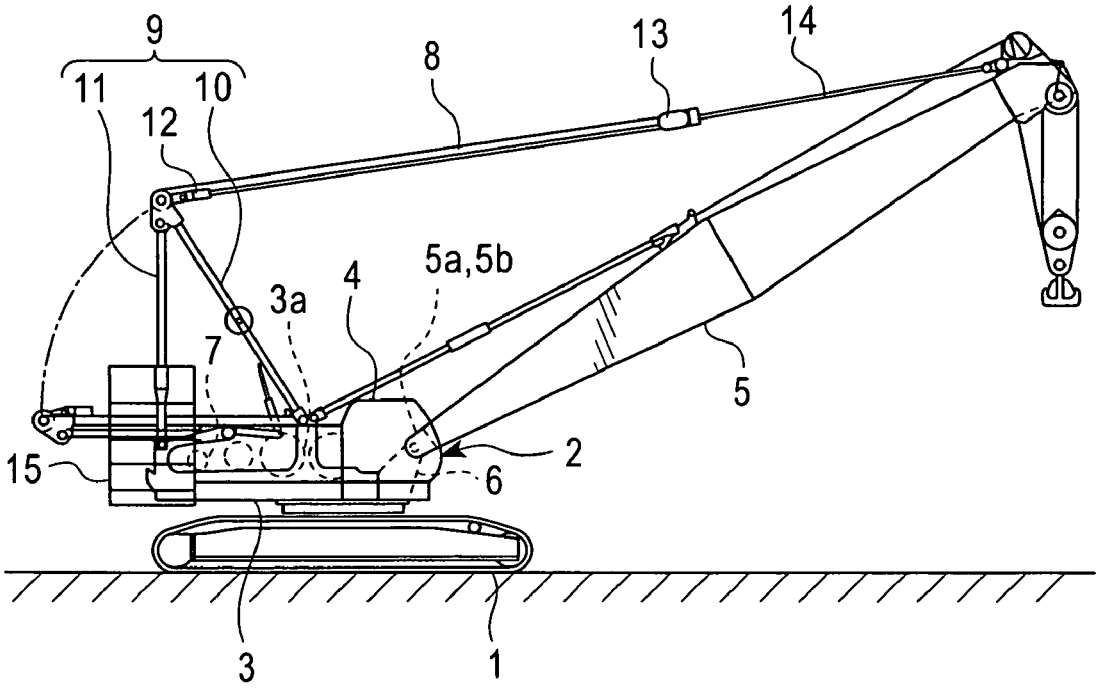
FIG. 4 is an overall schematic side view of a crawler crane as an example to which the present invention is applied.

In FIG. 4, an upper rotating body 2 is mounted on a lower traveling body 1. The upper rotating body 2 can rotate around the vertical axis.

The upper rotating body 2 has a rotating frame 3 as a base member. A cabin 4 as an operating room is provided on the left or right side of the front part of the rotating frame 3. Normally, the cabin 4 is provided on the right side. Hereinafter, such a case will be described.

The rotating frame 3 has main frames 3*a* and 3*b* disposed on the left side and the right side, respectively. The main frames 3*a* and 3*b* are a pair of vertical plates extending in the longitudinal direction. A pair of boom feet 5*a* and 5*b* of a lattice boom 5 are fitted to the front ends of the main frames 3*a* and 3*b*, respectively, via boom foot pins 6 and 6.

Therefore, the boom 5 can be raised and lowered around the boom feet 5*a* and 5*b*, and more specifically, around the boom foot pins 6 and 6. The boom 5 is raised and lowered by a rope 8 (shown only in FIG. 4) drawn out from a winch 7.

In order to help the boom 5 move upward and downward, a gantry 9 is provided in the rear part of the rotating frame 3, projecting upward. Between the gantry 9 and the boom 5, spreaders 12 and 13 are disposed. The spreaders 12 and 13 are termed a lower spreader and an upper spreader, respectively.

The gantry 9 has a front member 10 and a rear member 11. The lower spreader 12 is disposed at the top of the gantry 9. Among sheaves 12*a* of the lower spreader 12 and sheaves 13*a* of the upper spreader 13, the rope 8 is extended.

A boom guy line 14 is extended between the upper spreader 13 and the boom head. A counterweight 15 is disposed at the rear end of the rotating frame 3. In FIG. 1, O is the center of rotation of the upper rotating body 2.

In transit, the gantry 9 is folded backward as shown in FIG. 4. In FIG. 1, the gantry 9 is also folded.

Figure 1:
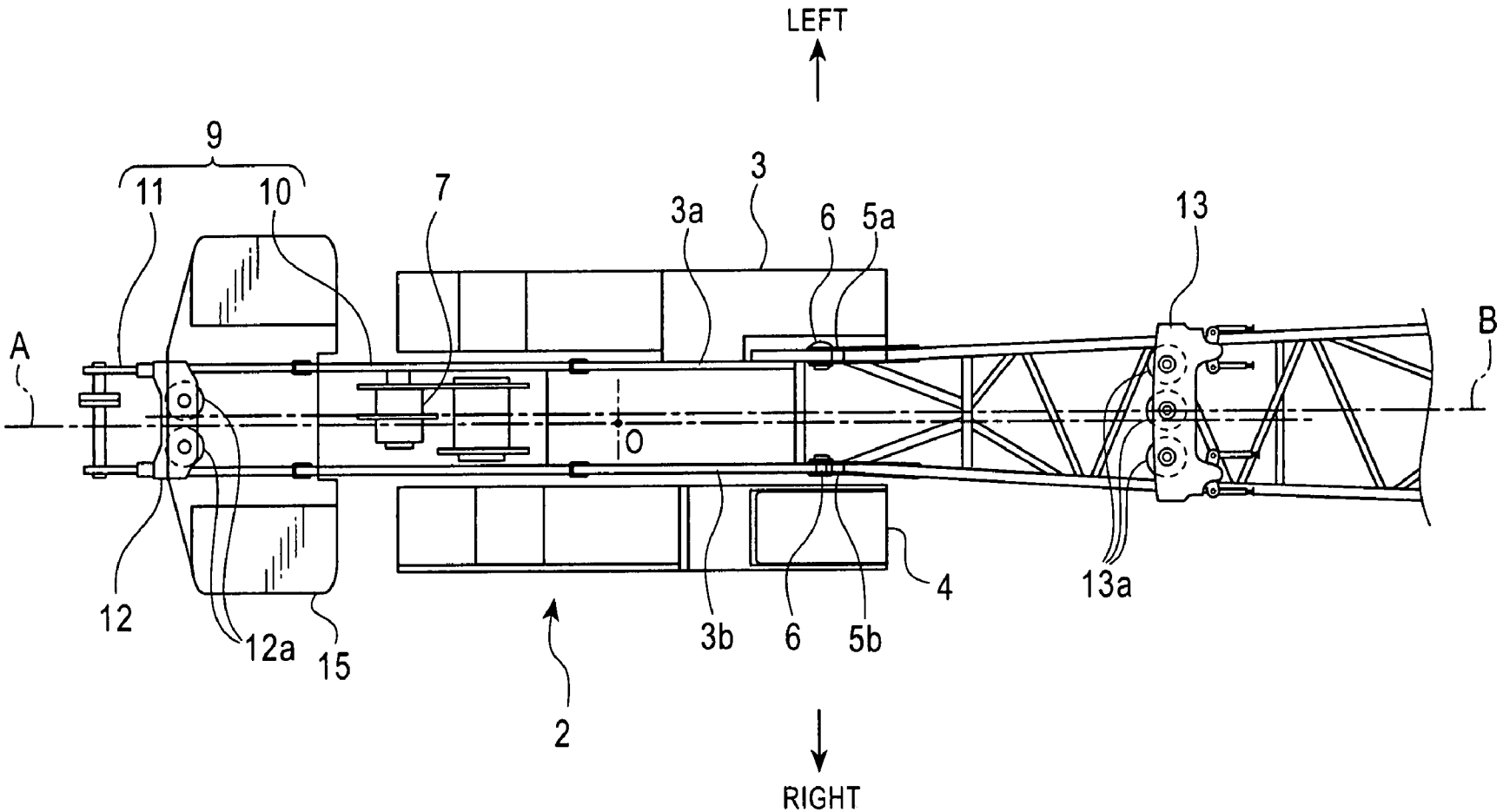
FIG. 1 is a plan view of a crawler crane according to a first embodiment of the present invention.
Figure 2:
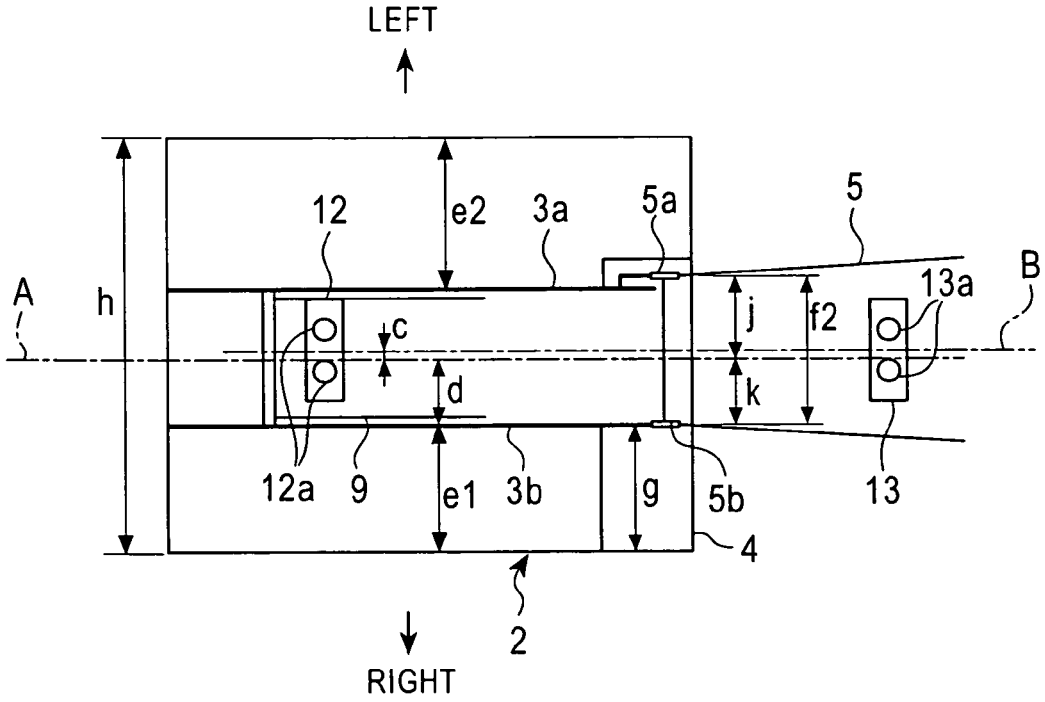
FIG. 2 is a schematic plan view of part of the crane in FIG. 1.
Figure 3:
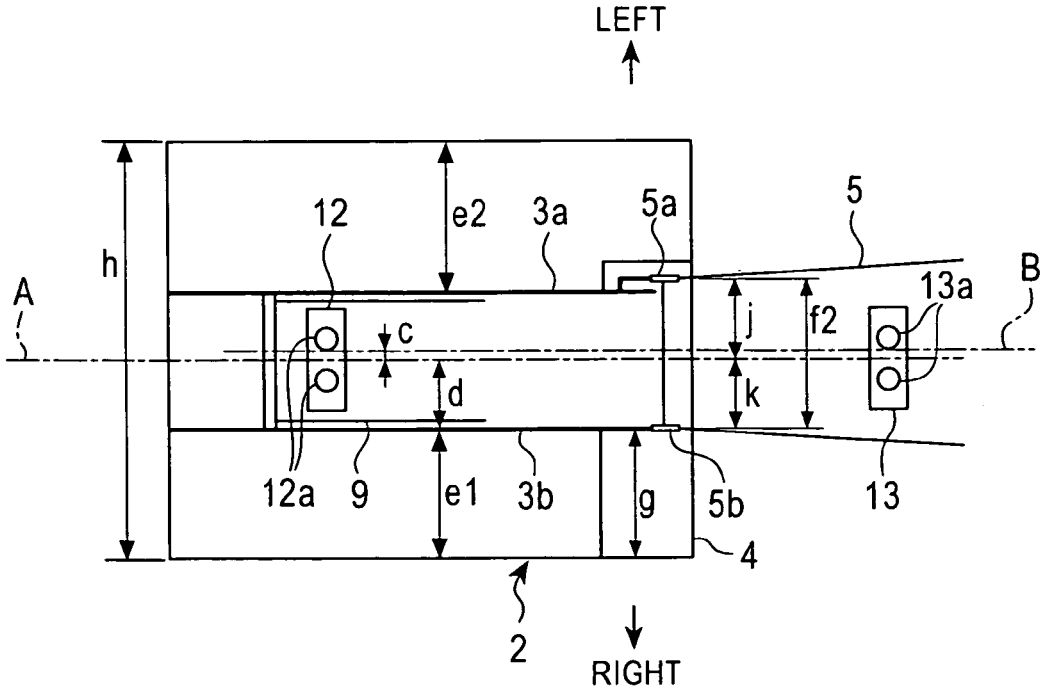
FIG. 3 is a schematic plan view of part of a crawler crane according to a second embodiment of the present invention, which is comparable to FIG. 2.

FIGS. 1 and 2 show a first embodiment of the present invention. FIG. 3 shows a second embodiment.

In both embodiments, the width h in transit (the width of the crane) is the limit value of the width of the crane in transit. The width g of the cabin 4 is determined based on a kind of standard such as ISO. Then, the position of the right boom foot 5*b* is automatically determined. The right boom foot 5*b* is disposed as near as possible to the cabin 4.

Therefore, the right boom foot 5*b* adjacent to the cabin 4 is located in the most right position determined by the width h in transit and the width g of the cabin 4.

As for the left boom foot 5*a*, there is no obstruction such as the cabin 4. Since the position of the left boom foot 5*a* can be determined flexibly, the distance j (see FIG. 2) between the left boom foot 5*a* and the center line A of the gantry 9 is greater than the distance k between the right boom foot 5*b* and the center line A of the gantry 9.

Unlike the related art in which the center line B of the boom 5 corresponds with the center line A of the gantry 9, the center line B of the boom 5 is located on the left side of the center line A of the gantry 9. The distance between the center lines A and B is c, which is half of the difference between the distances j and k.

Although the distance from the right end of the upper rotating body 2 to the center line A of the gantry 9 is e1+d, the distance f2 between the boom feet 5*a* and 5*b* is obtained from the following formula (1):

$$f2=(e1+d+c-g)\times 2 \quad (1)$$

Therefore, the distance f2 between the boom feet 5*a* and 5*b* can be twice c (2*c*) greater than the distance f1 (=(e1+d−g)×2) between the boom feet 5*a* and 5*b* in the related art. As described above, c is the distance between the center lines A and B.

This improves the load supporting ability of the boom S. Consequently, the weight of the boom 5 can be reduced. Alternatively, the length of the boom 5 can be increased.

In the first embodiment, the center lines of the lower and upper spreaders 12 and 13 are also located on the left side of the center line A of the gantry 9 so as to correspond with the center line B of the boom 5.

Therefore, the sheaves 12*a* of the lower spreader 12 and the sheaves 13*a* of the upper spreader 13 are evenly distributed on both sides of the center line B of the boom 5. The rope 8 (shown in FIG. 4) is extended among the sheaves of the spreaders 12 and 13. Consequently, the load applied to the boom 5 by the rope 8 is evenly distributed on both sides of the center line B of the boom 5.

That is to say, although the center line B of the boom 5 does not correspond with the center line A of the gantry 9, the force required to raise or lower the boom 5 is prevented from being applied to the boom 5 unevenly. Therefore, improvement in the load supporting ability of the boom 5 obtained by increasing the distance f2 between the boom feet 5*a* and 5*b* is made effective.

On the other hand, in the second embodiment shown in FIG. 3, the center lines of the spreaders 12 and 13 correspond with the center line A of the gantry 9. Other structures of the second embodiment are the same as the first embodiment.

In this embodiment, the load applied to the boom 5 by the rope 8 is unevenly distributed on both sides of the center line B of the boom 5. However, this embodiment has the advantage that the existing gantry 9 can be used without modifying the arrangement of the spreaders 12 and 13.

The problem where the load is unevenly applied to the boom 5 can be solved by providing an equalizer that equalizes the distribution of force to both sides of the center line B of the boom 5.

The above-described embodiments are the cases where the cabin 4 is disposed on the right side of the upper rotating body 2. As for the case where the cabin 4 is disposed on the left side, "left" and "right" in the above description are replaced with each other.

Although the invention has been described with reference to the preferred embodiments in the attached figures, it is noted that equivalents may be employed and substitutions made herein without departing from the scope of the invention as recited in the claims.

What is claimed is:

1. A crane comprising:

a lower traveling body;

an upper rotating body mounted on the lower traveling body, the upper rotating body having a rotating frame;

a cabin provided on a left or right side of the rotating frame;

a boom having a base supported in a front part of the rotating frame, the boom being raised and lowered around a pair of boom feet provided on left and right sides of the base of the boom;

a gantry provided behind the boom;

a plurality of spreaders disposed between the gantry and the boom, each of the spreaders having a sheave; and a winch for driving a rope extended between the sheaves, wherein the boom foot on the side of the cabin is located in a position which is a function of the width of the crane and the width of the cabin;

and a center line of the boom base is located on the opposite side of a center line of the gantry from the cabin so that the distance between the boom foot on the opposite side from the cabin and the center line of the gantry is greater than the distance between the boom foot on the side of the cabin and the center line of the gantry.

2. The crane according to claim 1, wherein the plurality of spreaders are a lower spreader and an upper spreader.

3. The crane according to claim 2, wherein center lines of the lower spreader and the upper spreader are located on the opposite side of the center line of the gantry from the cabin so as to correspond with the center line of the boom.

* * * * *